US010794544B2

(12) United States Patent
Ren et al.

(10) Patent No.: US 10,794,544 B2
(45) Date of Patent: Oct. 6, 2020

(54) LED LAMP

(71) Applicant: GE Lighting Solutions, LLC, East Cleveland, OH (US)

(72) Inventors: Xiaojun Ren, Shanghai (CN); Kun Xiao, Shanghai (CN); Zhifeng Bao, Xian (CN); Zhiyong Wang, Shanghai (CN); Yimin Zhu, Shanghai (CN)

(73) Assignee: Consumer Lighting (US), LLC, Norwalk, CT (US)

( * ) Notice: Subject to any disclaimer, the term of this patent is extended or adjusted under 35 U.S.C. 154(b) by 0 days.

(21) Appl. No.: 15/989,160

(22) Filed: May 24, 2018

(65) Prior Publication Data

US 2018/0363857 A1 Dec. 20, 2018

(30) Foreign Application Priority Data

Jun. 14, 2017 (CN) ..... 2017 1 0447399

(51) Int. Cl.
*F21V 29/00* (2015.01)
*F21K 9/232* (2016.01)
(Continued)

(52) U.S. Cl.
CPC ..... *F21K 9/232* (2016.08); *F21V 17/04* (2013.01); *F21V 19/004* (2013.01);
(Continued)

(58) Field of Classification Search
CPC ..... F21K 9/232; F21K 9/235; F21V 29/83; F21V 3/00; F21V 17/04; F21V 23/009;
(Continued)

(56) References Cited

U.S. PATENT DOCUMENTS 5,890,794 A * 4/1999 Abtahi ..... B60Q 7/00 362/294
8,536,807 B2 9/2013 Lin et al.
(Continued)

FOREIGN PATENT DOCUMENTS

CN 102628552 A 8/2012
CN 103697356 A 4/2014
(Continued)

OTHER PUBLICATIONS

Kelly-Detwiler, Peter, What? Another Efficient LED Light Bulb From Cree?, Forbes, Energy, Oct. 28, 2014, 4 pages, http://www.forbes.com/sites/peterdetwiler/2014/10/28/what-another-efficient-led-light-bulb-from-cree/#29a0e91612e0.
(Continued)

*Primary Examiner* — William J Carter
*Assistant Examiner* — Omar Rojas Cadima
(74) *Attorney, Agent, or Firm* — Wood IP LLC

(57) ABSTRACT

A LED lamp comprises a base, an envelope, a printed circuit board for mounting a plurality of LED chips and a supporting member for supporting the printed circuit board. The envelope has a bottom end coupled with the base. The envelope defines an interior between the base and the envelope, and the printed circuit board is disposed in the interior. The printed circuit board comprises a hollow structure. One end of the supporting member is assembled in the base, the other end of the supporting member is coupled with the printed circuit board. One end of the printed circuit board extends into the base.

16 Claims, 16 Drawing Sheets

(51) Int. Cl.

| | |
|---|---|
| ***F21V 23/00*** | (2015.01) |
| ***F21V 19/00*** | (2006.01) |
| ***F21V 29/83*** | (2015.01) |
| ***F21V 17/04*** | (2006.01) |
| *F21Y 107/30* | (2016.01) |
| *F21Y 107/40* | (2016.01) |
| *F21Y 115/10* | (2016.01) |
| *F21K 9/235* | (2016.01) |
| *F21V 3/00* | (2015.01) |

(52) U.S. Cl.
CPC ..... *F21V 23/005* (2013.01); *F21V 29/83* (2015.01); *F21K 9/235* (2016.08); *F21V 3/00* (2013.01); *F21V 23/009* (2013.01); *F21Y 2107/30* (2016.08); *F21Y 2107/40* (2016.08); *F21Y 2115/10* (2016.08)

(58) Field of Classification Search
CPC ..... F21Y 2115/10; F21Y 2107/30; F21Y 2107/40
USPC ..... 362/294
See application file for complete search history.

(56) References Cited

U.S. PATENT DOCUMENTS

| | | | | |
|---|---|---|---|---|
| 8,752,983 | B2 | 6/2014 | Hussell et al. | |
| 2011/0193479 | A1 | 8/2011 | Nilssen et al. | |
| 2011/0298371 | A1* | 12/2011 | Brandes | F21V 23/005 315/32 |
| 2012/0250325 | A1* | 10/2012 | Oki | F21V 29/15 362/249.02 |
| 2012/0287614 | A1* | 11/2012 | Kajiya | H05K 1/147 362/184 |
| 2015/0029701 | A1* | 1/2015 | Weidman | F21L 4/02 362/102 |
| 2016/0356428 | A1 | 12/2016 | Edmond et al. | |
| 2016/0377235 | A1 | 12/2016 | Progl et al. | |
| 2018/0135811 | A1* | 5/2018 | Soni | F21V 19/003 |

FOREIGN PATENT DOCUMENTS

| | | | |
|---|---|---|---|
| CN | 105588025 | A | 5/2016 |
| CN | 205909016 | U | 1/2017 |
| WO | 20150197805 | A1 | 12/2015 |
| WO | 2016194005 | A1 | 12/2016 |

OTHER PUBLICATIONS

Lamonica, Martin, Cree Engineers a Cheaper LED Bulb by Losing the Heat Sink, Spectrum, IEEE, Oct. 28, 2014, 3 pages, http://spectrum.ieee.org/tech-talk/semiconductors/devices/cree-loses-heat-sink-to-engineer-cheaper-led-bulb.

First Office Action for Chinese Patent Appl. No. 201710447399.1, dated Jan. 3, 2020, 11 pages.

* cited by examiner

LED LAMP

BACKGROUND

Embodiments of the present disclosure relate to LED lamps, and especially to simple structured LED lamps without heat sinks.

In recent years, LED lamps have been developing rapidly due to many advantages such as high energy efficiency, long service life, compact size, and environmental friendliness. An era of replacing fluorescent lamps with LED lamps has come. The LED lamp is characterized by high quality, durability, and energy saving. Its advantages, such as a wide adjustment range of projection angle, high temperature resistance, moisture proofing, water proofing and anti-creep, make it a mainstream in the lighting field, while replacing the conventional fluorescent lamps.

The conventional LED lamp mainly includes a lamp base, a lamp base fitting, a lamp housing, an LED driving power source, a circuit board assembled with LED chips, a circuit board clamp, and a heat sink, wherein the lamp base, the lamp base fitting and the lamp housing are connected to each other to form an external structure of the LED lamp. The LED driving power source, the circuit board assembled with the LED chips, the circuit board clamp, and the heat sink are connected to each other to form an internal structure of the LED lamp. The circuit board clamp is configured to clamp the circuit board and fix the LED driving power source and the heat sink. Meanwhile, the internal structure of the LED lamp matches and is fixed in the external structure of the LED lamp. The LED driving power source is configured to supply power to the LED chips, and the heat sink is configured to dissipate heat from the LED chips.

Because the heat-sinking capacity of the conventional LED chip is limited, the heat sink is an indispensable device to avoid impacts on a lifespan and stability of the LED chip which is caused by long-term use in a high-temperature environment. However, the heat sink is bulky and heavy, which will affect the overall design and luminescence of the LED lamp and greatly increase the manufacturing and transportation costs.

There is also a conventional method for solving the heat dissipation problem of the LED lamp. The method comprises filling the LED lamp with at least one of hydrogen gas, helium gas, and nitrogen gas, whereby heat generated by the LED chip is conducted and radiated to the gas in the LED lamp. Therefore, the heat generated by the light emitting module can be efficiently conducted to the housing via the gas and dissipated to the outside of the lamp. However, the LED lamp that needs to be inflated requires a complicated manufacturing process, a good impermeability and a high manufacturing cost.

Therefore, it is desirable to provide new LED lamps without heat sinks and gas therein for dissipation.

BRIEF DESCRIPTION

A LED lamp comprises a base, an envelope and a printed circuit board for mounting a plurality of LED chips. The envelope has a bottom end coupled with the base. The envelope defines an interior between the base and the envelope. The printed circuit board is disposed in the interior. The printed circuit board comprises a hollow structure. The LED lamp further comprises a supporting member for supporting the printed circuit board. The supporting member has one end assembled in the base and the other end coupled with the printed circuit board. One end of the printed circuit board extends into the base.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
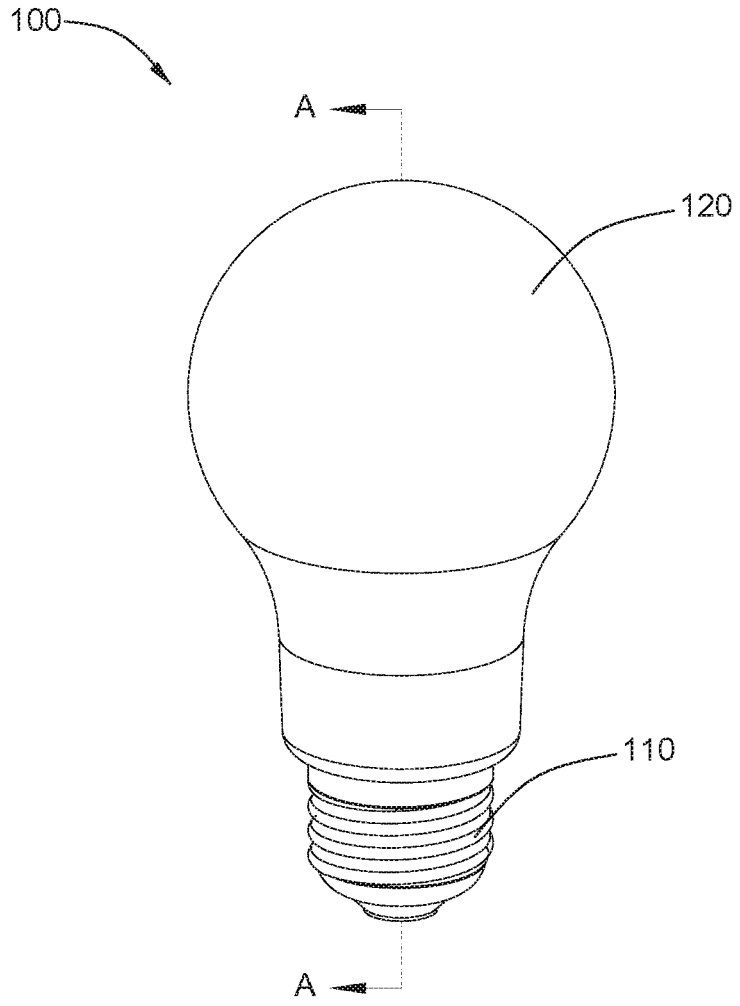
FIG. 1 is a perspective view of an LED lamp in accordance with an exemplary embodiment of the present disclosure.
Figure 2:
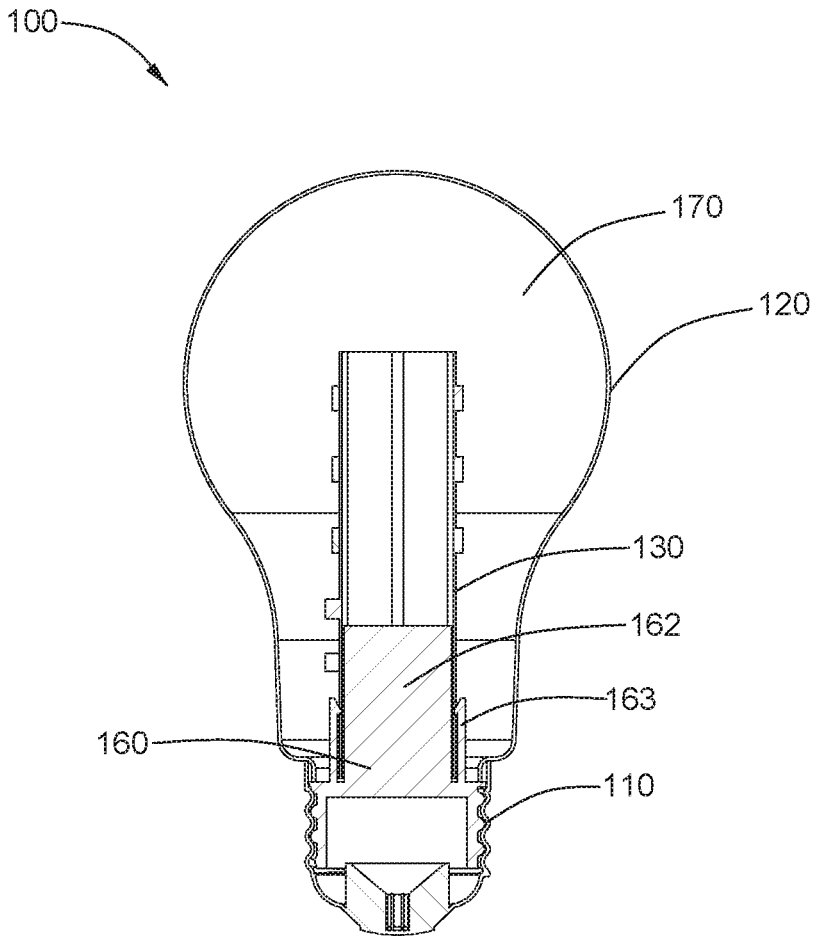
FIG. 2 is a sectional view of the LED lamp shown in FIG. 1 taken along line A-A.

Unless defined otherwise, technical and scientific terms used herein have the same meaning as is commonly understood by one of ordinary skill in the art to which the present disclosure belongs. The terms "first", "second", and the like, as used herein do not denote any order, quantity, or importance, but rather are used to distinguish one element from another. Also, the terms "a" and "an" do not denote a limitation of quantity, but rather denote the presence of at least one of the referenced items. The approximate language used in this paper can be used for quantitative expressions, indicating that a certain amount of variation can be allowed without changing basic functions. Therefore, numerical values modified by languages such as "about" and "around" are not limited to the exact numerical value itself. Similarly, the terms "a" and "an" do not denote a limitation of quantity, but rather denote the presence of at least one of the referenced items. The use of "comprising" or "having" variations thereof herein means that the element or object preceding "comprising" or "having" encompasses any element or article listed after "comprising" or "having" and its equivalence, and does not exclude other elements or objects. The terms "connecting", "connected", "coupled" and the like are not limited to physical or mechanical connections, but may include direct or indirect electrical connections, or include thermal connections, thermally conductive connections, heat transfer connections and so on.

FIGS. 1-5 show a new LED lamp 100 in accordance with an exemplary embodiment of the present disclosure, wherein the LED lamp comprises a base 110, an envelope 120, a printed circuit board 130, a driver circuit 140 and a plurality of LED chips 150 integrated on the printed circuit board 130, and a supporting member 160 configured to support and fix the printed circuit board 130.

The base 110 is a standardized threaded part in some embodiments of the present disclosure. The base 110 defines an internal thread 111 configured to mount and fix the supporting member 160.

The envelope 120 has a hollow structure. In some embodiments of the present disclosure, the envelope 120 has a same shape as a conventional incandescent lamp, which comprises a substantially spherical top portion 121 and a bottom portion 122 under the top portion and substantially in a shape of hollow cylinder. The envelope 120 has an overall shape of sphere that expands from the bottom portion 122. The bottom portion 122 of the envelope 120 is connected to the base 110. The envelope defines an interior 170 between the base 110 and the envelope 120 and configured to receive the printed circuit board 130. The envelope 120 may be made of a transparent material, so that light emitted by the LED chip 150 can be transmitted to the outside of the LED lamp 100. In some embodiments of the present disclosure, the base 120 is made of a transparent plastic by simple manufacturing process, and the base is not easy to break. In addition, the envelope 120 may also be made of glass or transparent ceramic.

Figure 3:
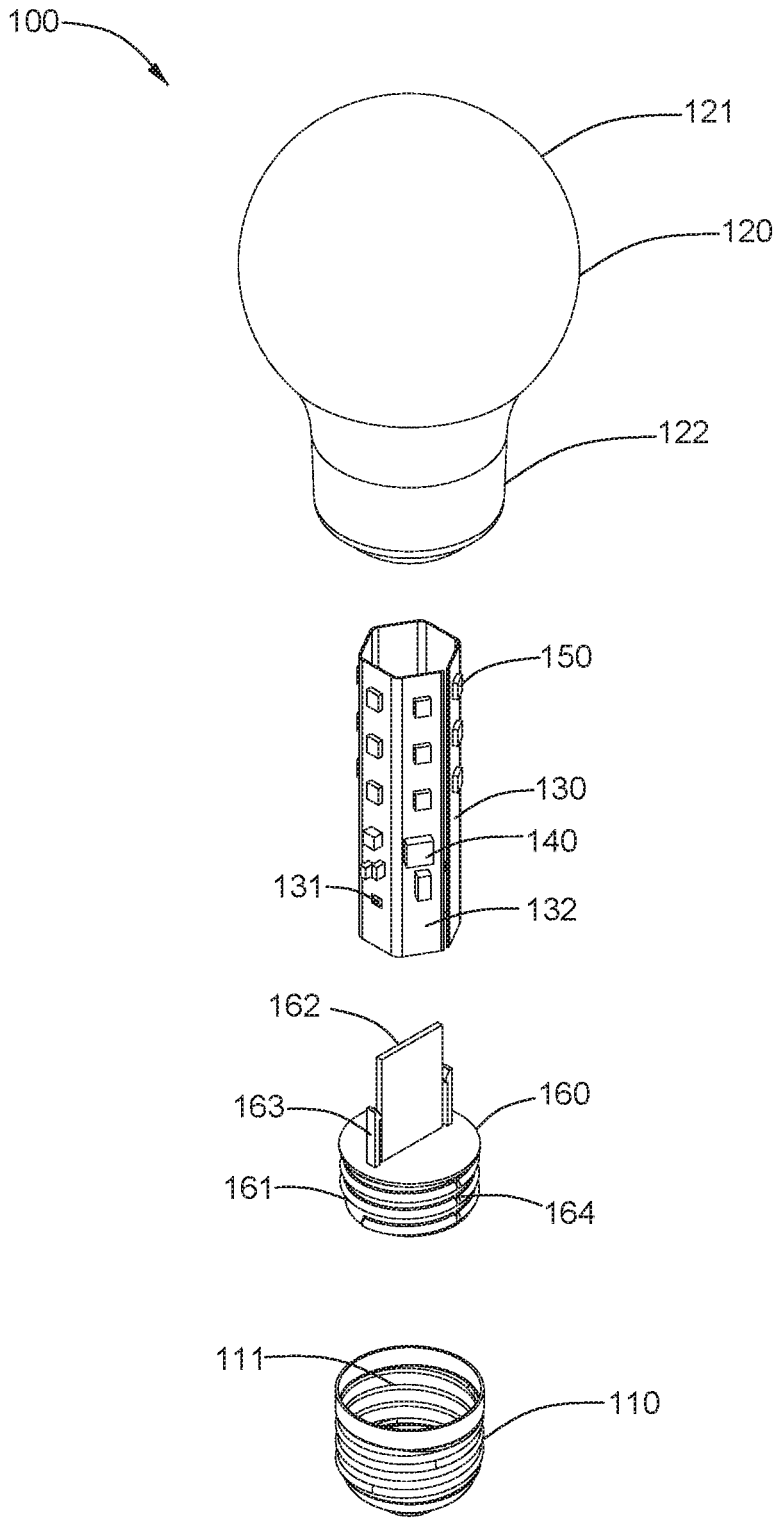
FIG. 3 is an exploded perspective view of the LED lamp shown in FIG. 1.

Referring to FIG. 3, in some embodiments of the present disclosure, the supporting member 160 is integrally formed of plastic, so that the manufacturing process of the supporting member 160 is relatively simple. The supporting member 160 comprises a base portion 161, a flat supporting portion 162 extending upwardly and vertically from a top end of the base portion 161, and latch portions 163 symmetrically provided on both sides of the supporting portion 162. A gap is left between the latching portion 163 and the supporting portion 162 configured to receive the printed circuit board 130. The base portion 161 is substantially cylindrical and is received in the base 110. The base portion 161 comprises a base thread 164 on an outer surface thereof, and the base thread 164 is configured to mate with the internal thread 111 of the base 110 to fix the supporting member 160 in the base 110.

Figure 4:
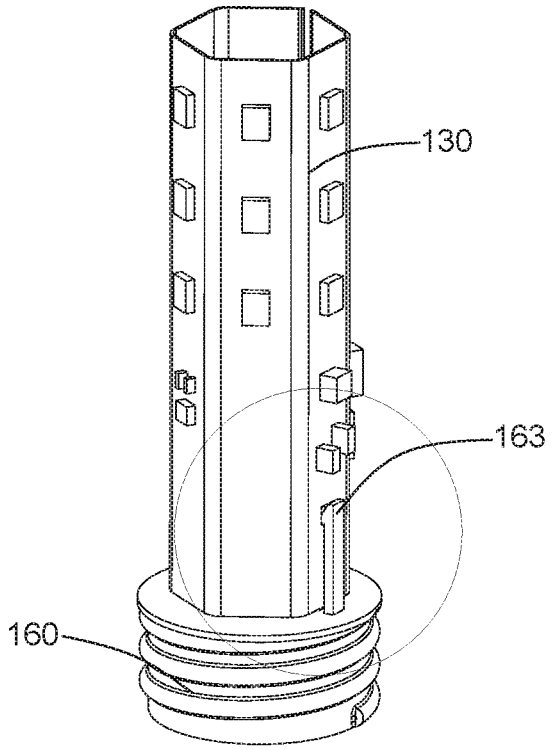
FIG. 4 is a sketch view of a printed circuit board assembled on a supporting member of the LED lamp shown in FIG. 1.
Figure 5:
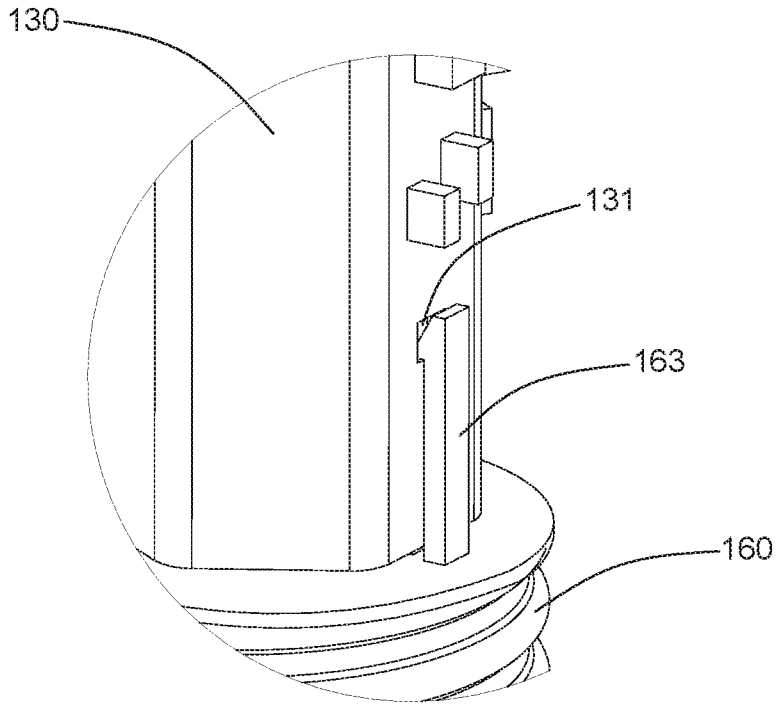
FIG. 5 is a partial enlarged view of a portion inside a circle shown in FIG. 4.
Figure 6:
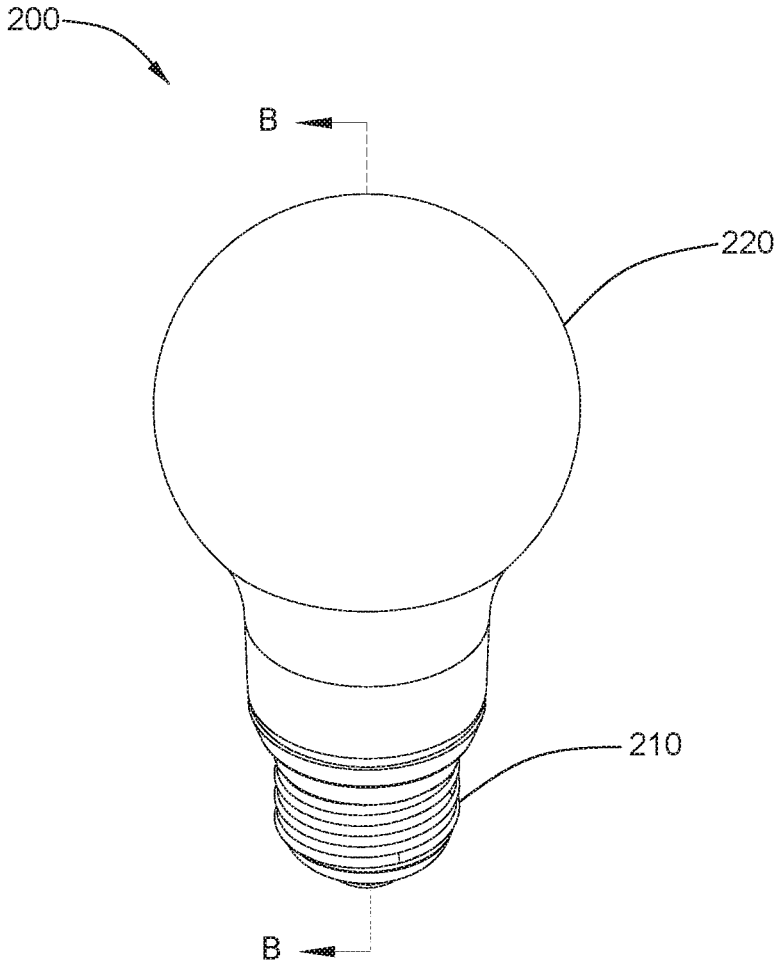
FIG. 6 is a perspective view of an LED lamp in accordance with an exemplary embodiment of the present disclosure.
Figure 7:
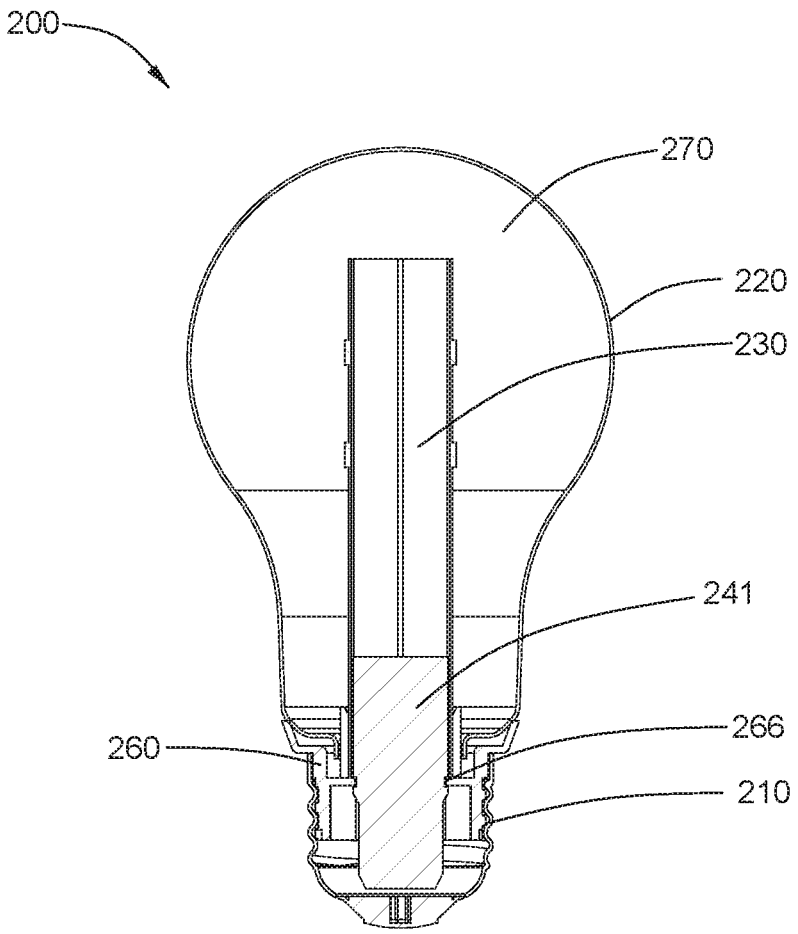
FIG. 7 is a sectional view of the LED lamp shown in FIG. 6 taken along line B-B.

In some embodiments of the present disclosure, the printed circuit board 130 is a flexible circuit board comprising a hollow structure. It may comprise a hollowed polyhedron, or a hollowed cylinder, or other annular structures. Referring to FIGS. 3-5, in an embodiment of the present disclosure, the printed circuit board 130 is substantially in a shape of a hollow hexahedron, comprising six mounting sides 132, each of which is substantially flat and rectangular. In an embodiment of the present disclosure, one end of the printed circuit board 130 may be mounted and fixed on the supporting member 160, and the other end is suspended in the interior 170 of the envelope 120. The end of the printed circuit board 130 fixed on the supporting member 160 extends into the base 110. The mounting sides 132 of the printed circuit board 130 is perpendicular to an upper surface of the base portion 161 of the supporting member 160. The LED lamp in the present disclosure does not need a heat sink, and the entire interior 170 is configured to receive and fix the printed circuit board 130. Therefore, the mounting side 132 of the printed circuit board 130 is bigger than the mounting side of the printed circuit board in the conventional LED lamp. The driver circuit 140 and the plurality of LED chips 150 are integrally provided on the printed circuit board 130. The plurality of LED chips 150 can be evenly distributed on an upper half of the six mounting sides 132 of the printed circuit board 130, so that the LED lamp 100 can have a better light emitting effect. Meanwhile, the LED chips 150 can be relatively dispersedly installed on the plurality of mounting sides 132 of the printed circuit board 130, so that heat generated by the plurality of LED chips 150 can be dissipated more easily without a separate heat sink for heat dissipation. The driver circuit 140 is provided on one of the mounting sides 132 of the printed circuit board 130 and is located below the LED chips 150 on the mounting side 132. The driver circuit 140 is integrated on the printed circuit board 130, thereby simplifying the structure of the LED lamp and reducing the manufacturing cost. The printed circuit board 130 also defines a pair of holes 131 symmetrically provided on two opposite mounting sides 132, and the pair of holes 131 is configured to match with the latch portions 163 of the supporting member 160 to mount and fix the printed circuit board 130 on the supporting member 160. In this way, the printed circuit board 130 can be vertically mounted and fixed inside the envelope 120 and is located on a central axis of the envelope 120 and the base 110, in such a manner that the LED lamp 100 can emit light in all directions and have a better luminous transmittance.

When assembling, the printed circuit board 130 integrated with the driver circuit 140 and the plurality of LED chips 150 is firstly mounted on the supporting member 160. The printed circuit board 130 is retained between the supporting portion 162 and the latch portions 163 of the supporting member 160, and the latch portions 163 of the supporting member 160 is retained in the holes 131 of the printed circuit board 130. Then, the supporting member 160 assembled with the printed circuit board 130 is installed in the base 110, and the supporting member 160 is fixed in the base 110 by matching the base thread 164 with the internal thread 111 of the base 110. Finally, the envelope 120 is mounted on the base 110, and the envelope 120 and the base 110 are packaged together with glue. After the assembling, one end of the hollow printed circuit board 130 is mounted and fixed on the supporting member 160 and extends into the base 110, and the other end is suspended in the interior 170 of the envelope 120. In this way, the printed circuit board 130 of the LED lamp 100 can have a larger mounting area than a conventional printed circuit board, and the LED chips 150 can be distributed on the printed circuit board 130 in a more dispersed way. Therefore, the LED lamp 100 has a better self-heat-dissipation effect, and there is no need to additionally provide a separate heat sink. Meanwhile, the hollow printed circuit board 130 is vertically mounted and fixed on the supporting member 160 along the direction of the central axis of the base 110 and the envelope 120, so that the LED lamp 100 has a better lighting effect.

FIGS. 6-13 show an LED lamp 200 in accordance with an exemplary embodiment of the present disclosure. The LED lamp 200 comprises a base 210, an envelope 220, a printed circuit board 230, a plurality of LED chips 250 mounted on the printed circuit board 230, a driver circuit 240, and a supporting member 260 configured to support and fix the printed circuit board 230 and the driver circuit 240. The base 210 defines an internal thread 211. The envelope 220 comprises a spherical top portion 221 and a bottom portion 222 under the top portion. The bottom portion 222 is substantially in a shape of hollow cylinder and connected to the base 210. The envelope 220 defines an interior 270 configured to receive the printed circuit board 230. The printed circuit board 230 is also in a shape of a hollow hexahedron, comprising six mounting sides 132, each of which is substantially flat and rectangular. The plurality of LED chips 250 are evenly distributed on the six mounting sides 232 of the printed circuit board 230, so that the LED lamp 200 can emit light evenly. The overall structure and working principle of the base 210, the printed circuit board 230 and the envelope 220 of the LED lamp 200 in the second embodiment are similar to those of the LED lamp 100 in the above embodiment, which will not be repeated here.

Figure 8:
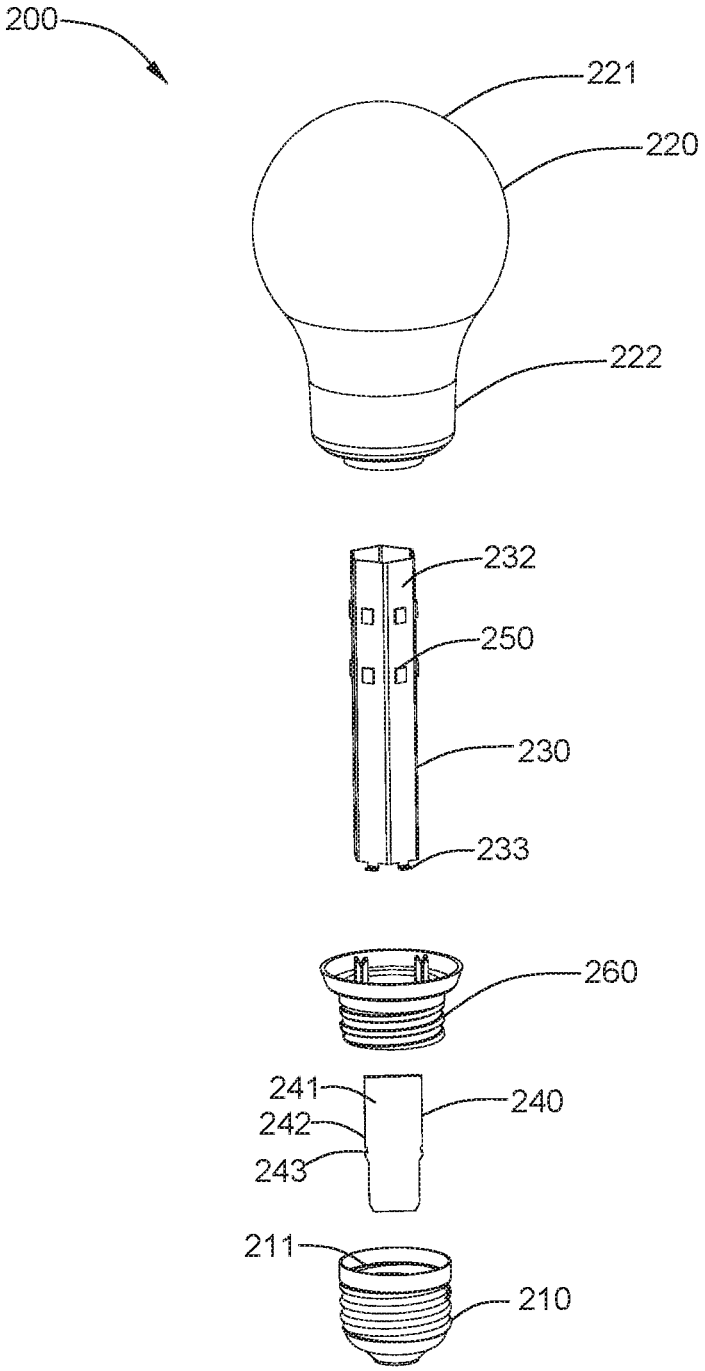
FIG. 8 is an exploded perspective view of the LED lamp shown in FIG. 6
Figure 9:
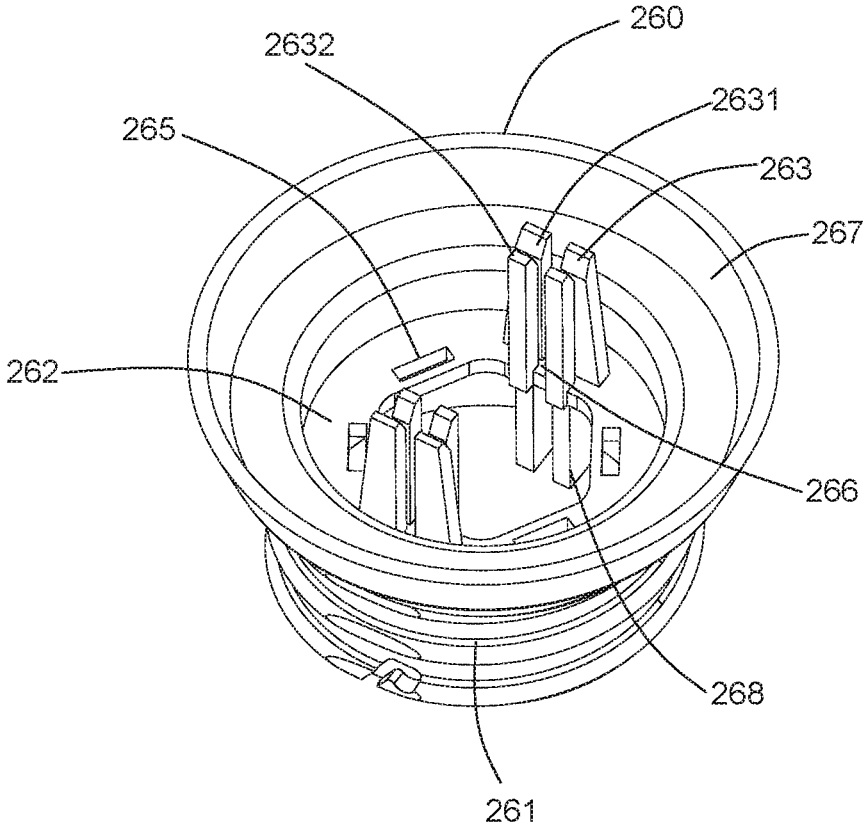
FIG. 9 is a perspective view of a support member of the LED lamp shown in FIG. 6.
Figure 10:
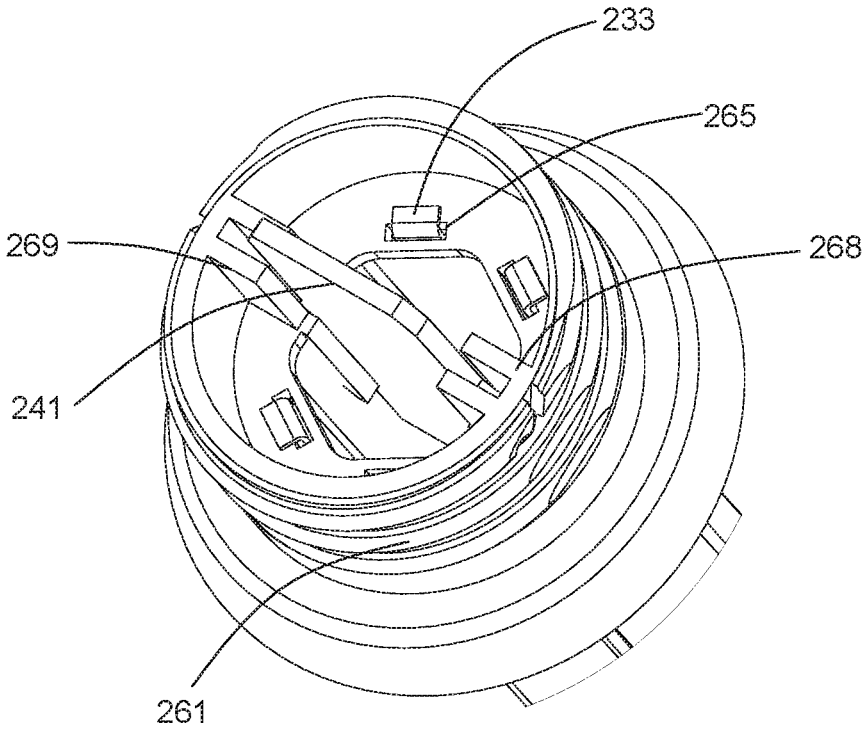
FIG. 10 is a perspective view of the supporting member of the LED lamp shown in FIG. 6 from another angle.
Figure 11:
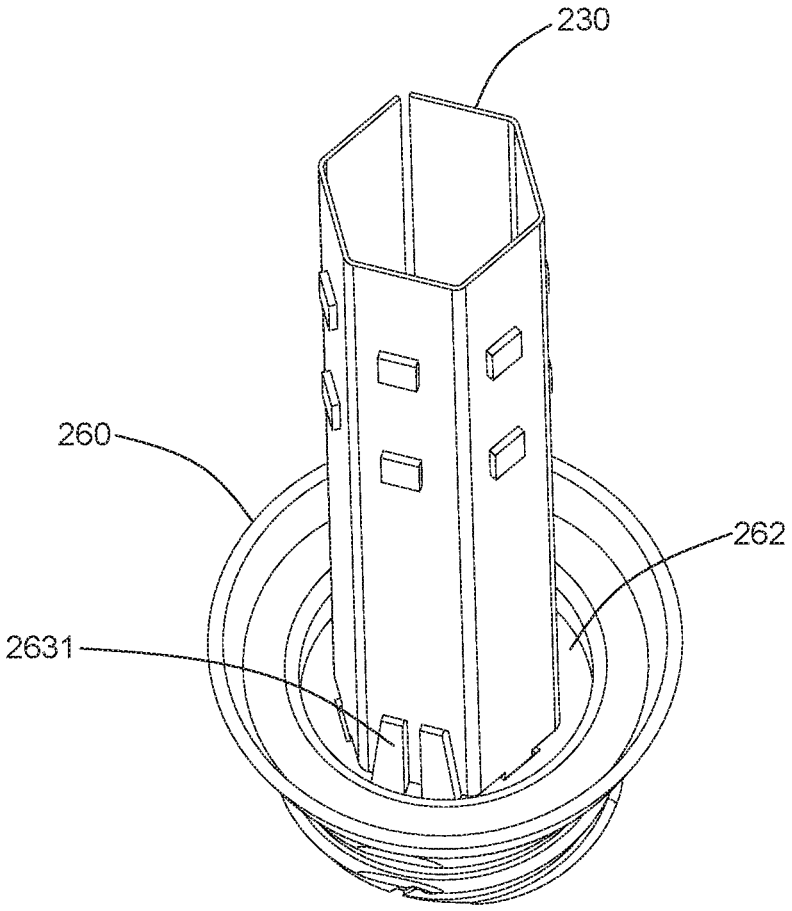
FIG. 11 is a sketch view of a printed circuit board of the LED lamp shown in FIG. 6, which is assembled on the supporting member.
Figure 12:
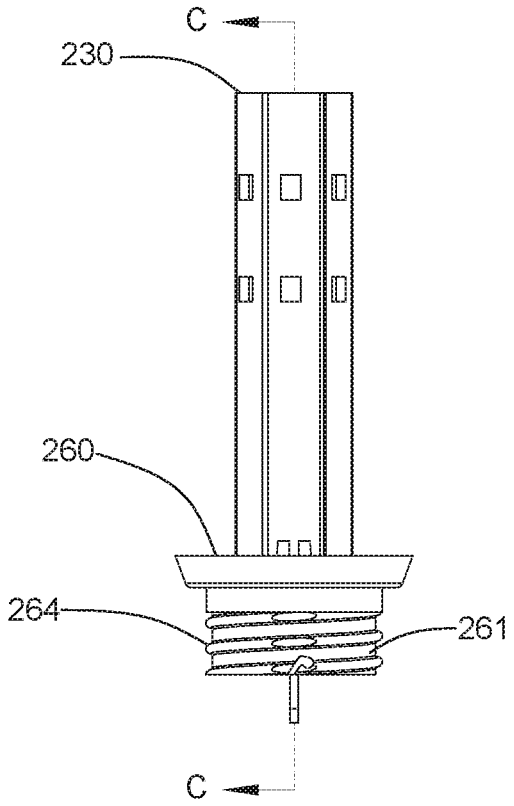
FIG. 12 is a sketch view of the printed circuit board of the LED lamp shown in FIG. 6 from another angle, wherein the printed circuit board is assembled on the supporting member.
Figure 13:
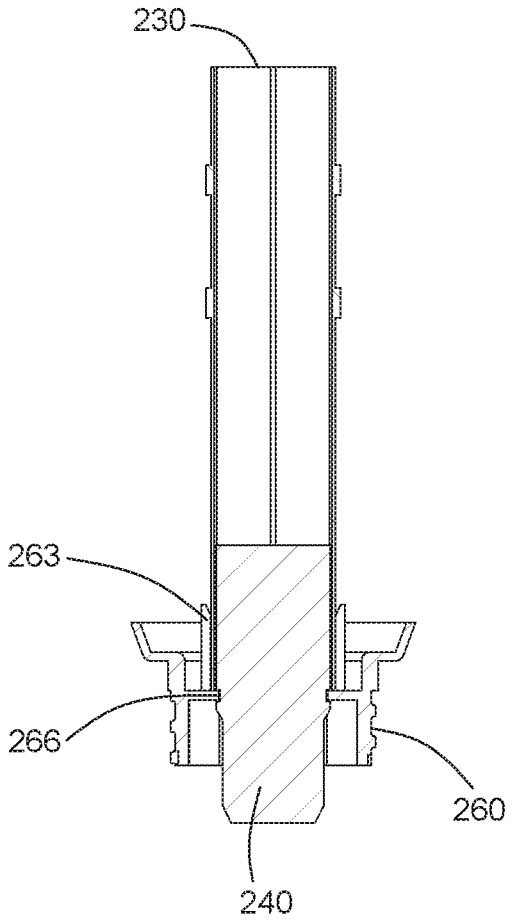
FIG. 13 is a sectional view of the printed circuit board of the LED lamp shown in FIG. 12 taken along line C-C, wherein the printed circuit board is assembled on the supporting member.

Referring to FIG. 8, the difference between the LED lamp 200 in accordance with an exemplary embodiment of the present disclosure and the LED lamp 100 in accordance with the above embodiment is that the LED chips 250 and the driver circuit 240 are separately provided. The printed circuit board 230 comprises four projection portions 233 extending downward from bottom ends of four mounting sides opposite to each other, which are configured to fix the printed circuit board 230 on the supporting member 260. One end of the printed circuit board 230 is mounted and fixed on the supporting member 260, and the other end is suspended in the interior 270 of the envelope 220. The end of the printed circuit board 230 which is fixed on the supporting member 260 extends into the base 210.

Referring to FIGS. 8-13, the supporting member 260 is integrally formed of plastic. The supporting member 260 has an axially symmetrical structure, which comprises a hollow annular base portion 261, a floor portion 262 within the base portion 261, and a receiving portion 267 extending outward and upward from a top end of the base portion 261. A base thread 264 is provided on an outer side of the base portion, and the base thread 264 is configured to mate with the internal thread 211 of the base 210 to mount and fix the supporting member 260 on the base 210. A diameter of the receiving portion 267 is larger than a diameter of the base portion 261, and the receiving portion 267 is configured to receive the bottom portion 222 of the envelope 220. The floor portion 262 is also in a shape of ring. The supporting member 260 further comprises holding portions 263 provided in pairs and extending upwardly from a top end of the floor portion 262. The holding portions comprise four pairs of holding portions which are oppositely disposed, and each two pairs are provided adjacently at one side of the floor portion 262. The holding portions comprise a pair of external holding portions 2631 and a pair of internal holding portions 2632. The internal holding portions 2632 are positioned at a radially inner portion of the floor portion which is close to a circle center, and the external holding portions 2631 are positioned at a radially outer portion of the floor portion which is away from the circle center. The printed circuit board 230 is retained between the external holding portions 2631 and the internal holding portions 2632 which are provided adjacently. The mounting sides 232 of the printed circuit board 230 are perpendicular to an upper surface of the floor portion 262 of the supporting member 260. The supporting member 260 further comprises a protrusion 266 provided between two adjacent internal holding portions 2632 and extends inwardly from the floor portion 262. The supporting member 260 further comprises two guiding portions 268 extending vertically and downwardly from a bottom end of the floor portion 262. The guiding portions 268 are symmetrically provided on two opposite sides of the bottom end of the floor portion 262, and are respectively provided corresponding to the internal holding portions 2632 of the holding portion 263. The guiding portion 268 comprises guide plates 269 arranged in parallel and spaced apart from each other, and the guiding plates 269 are respectively disposed corresponding to the internal holding portions 2632 of the holding portions 263. The supporting member 260 further comprises four positioning holes 265 provided on the floor portion 262 and spaced apart from each other. The four positioning holes 265 respectively correspond to the four projection portions 233 of the printed circuit board 230. The four positioning holes 265 penetrate through the floor portion 262 of the supporting member 260 for mounting and fixing the projection portions 233 of the printed circuit board 230.

Referring to FIGS. 7-12, the driver circuit 240 comprises a driving board 241 substantially in a shape of rectangular plate, on which a driving circuit (not shown) for driving the LED lamp 200 is provided. An upper half of the driving board 241 is received in the internal holding portion 2632 of the supporting member 260, and protrudes beyond the internal holding portions 2632. A lower half of the driving board 241 is received in the guiding portions 268. The driving board 241 has two slots 243 provided at two opposite longitudinal sides 242 thereof, and the slots are configured to engage with the protrusions 266 of the supporting member 260 to fix the driving board 241 to the supporting member 260.

When assembling, the driving board 241 is firstly installed via the guiding portion 268 of the supporting member 260 from bottom to top, so that the upper half of the driving board 241 is retained between the internal holding portions 2632 of the supporting member 260. Meanwhile, the driving board 241 is fixed to the supporting member 260 by matching the slots 243 of the driving board 241 with the protrusions 266 of the supporting member 260. The lower half of the driving board 241 is received in the guiding portion 268 of the supporting member 260. Then, the printed circuit board 230 is installed from top to bottom, and the printed circuit board 230 is retained between the external holding portions 2631 and the internal holding portions 2632 of the holding portions 263. Meanwhile, the upper half of the driving board 241 can support the printed circuit board 230 to prevent the printed circuit board 230 from shaking. Furthermore, the projection portions 233 of the printed circuit board 230 is received in the positioning holes 265 of the supporting member 260, and protrudes beyond the bottom of the floor portion 262. Then, the printed circuit board 230 is fixed to the supporting member 260 by bending the part of the projection portions 233 protruding beyond the bottom. Then, the supporting member 260 mounted with the printed circuit board 230 and the driving board 241 is installed in the base 210, and the base thread 264 of the supporting member 260 engages with the internal thread 211 of the base 210 to fix the supporting member 260 in the base 210. Finally, the envelope 220 is retained in the receiving portion 267 of the supporting member 260, and the envelope 220 is fixed to the supporting member 260 by sealing with glue. In a second embodiment, the printed circuit board 230 may firstly be mounted on the supporting member 260, and then the driver circuit board 240 may be installed and fixed on the supporting member 260 from bottom to top. The order of mounting the printed circuit board 230 and the driver circuit 240 to the supporting member 260 is not limited.

Figure 14:
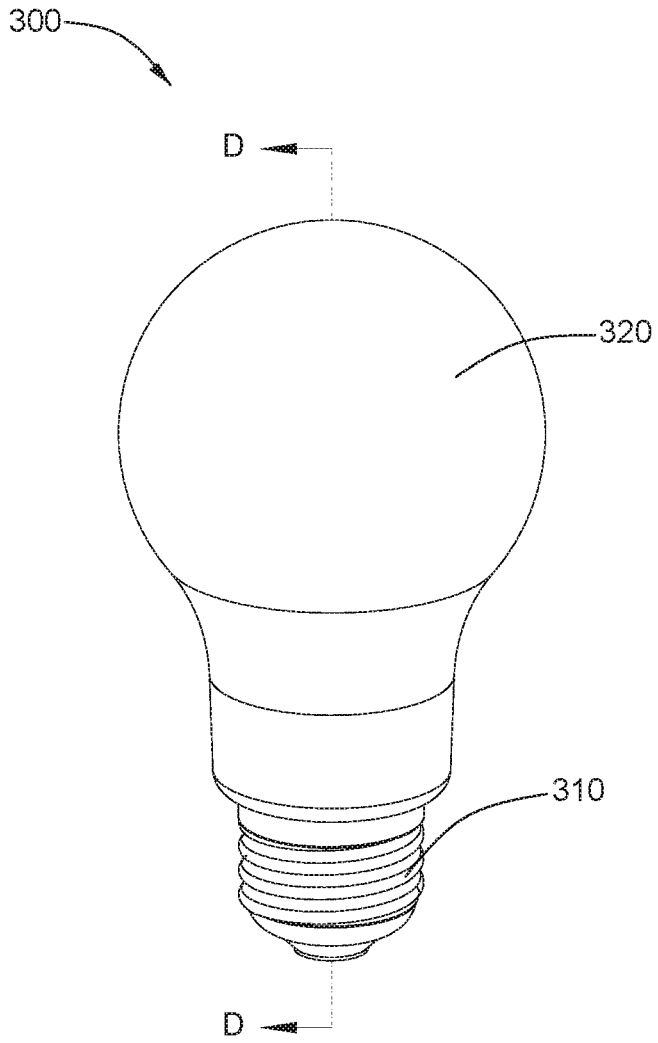
FIG. 14 is a perspective view of an LED lamp in accordance with an exemplary embodiment of the present disclosure.
Figure 15:
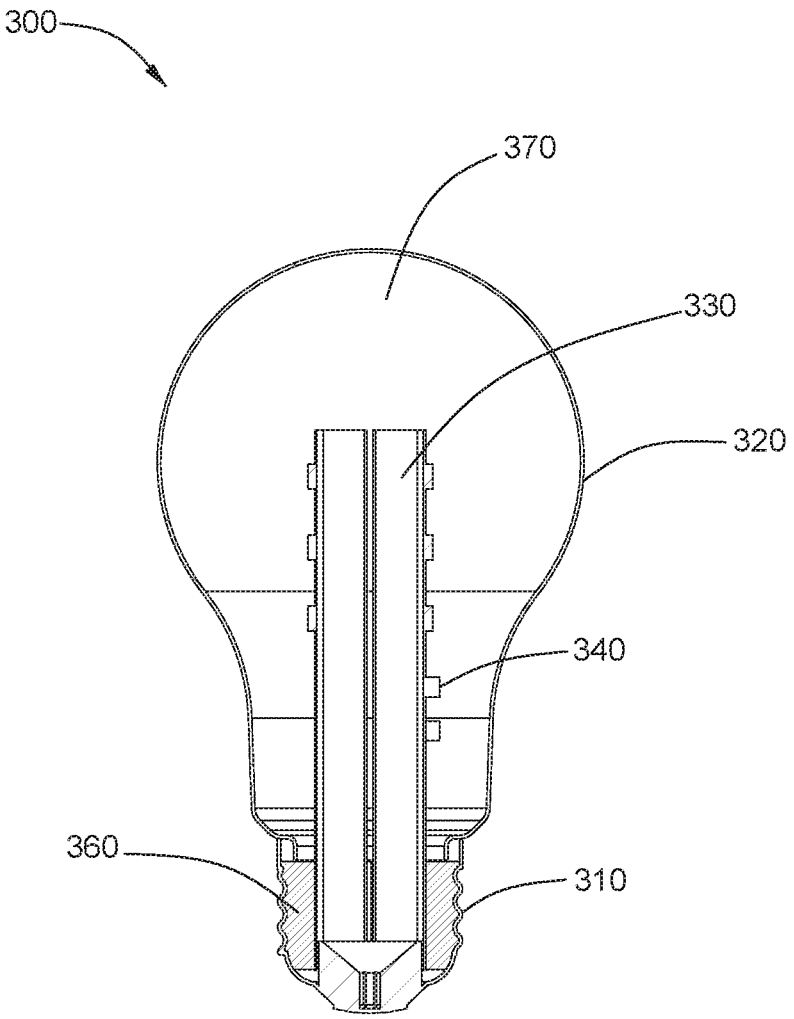
FIG. 15 is a sectional view of the LED lamp shown in FIG. 14 taken along line D-D.
Figure 16:
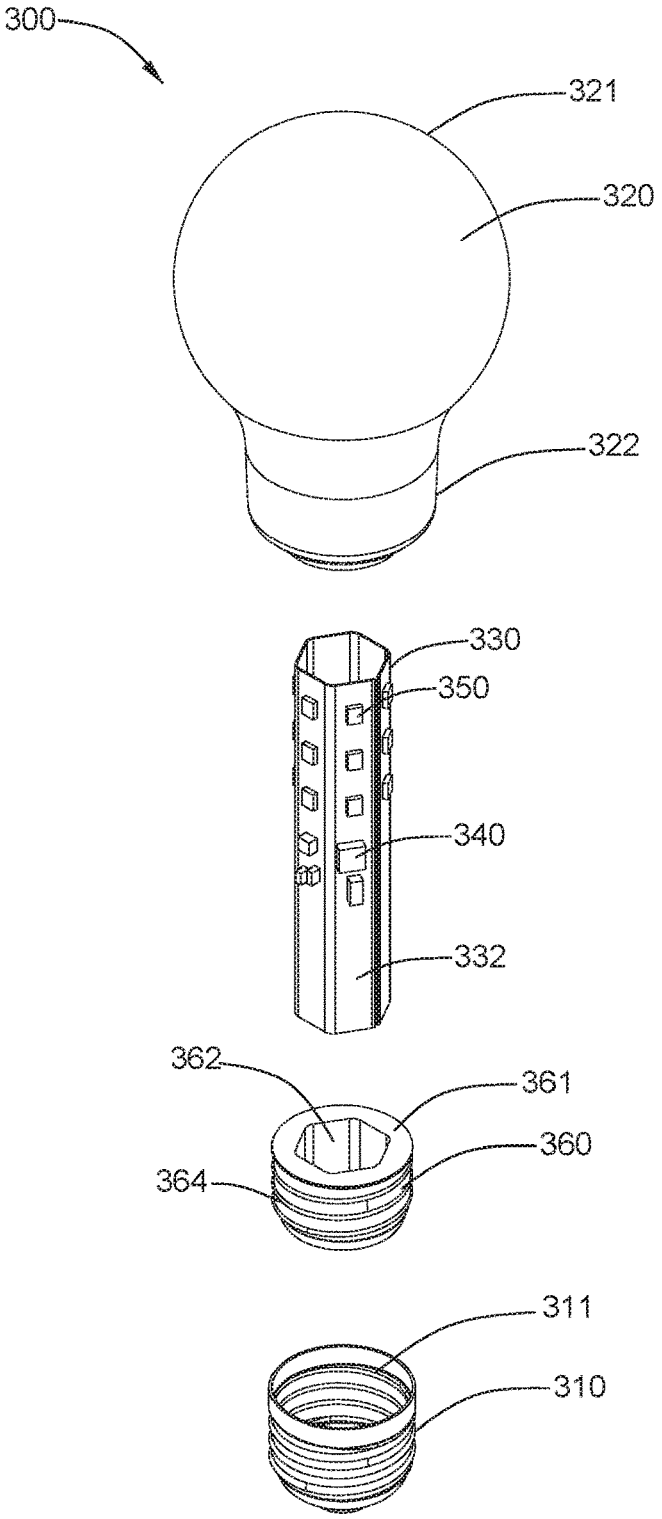
FIG. 16 is an exploded perspective view of the LED lamp shown in FIG. 15.

FIGS. 14-16 show an LED lamp 300 in accordance with an exemplary embodiment of the present disclosure. The LED lamp 300 comprises a base 310, an envelope 320, a printed circuit board 330, and a plurality of LED chips 350 and a driver circuit 340 integrated on the printed circuit board 330. The base 310 defines an internal thread 311. The envelope 320 comprises a spherical top portion 321 and a bottom portion 322 under the top portion. The bottom portion 322 is substantially in a shape of hollow cylinder and connected to the base 310. The envelope 320 defines an interior 370 between the base 310 and the envelope 320 for receiving the printed circuit board 330. The overall structure and working principle of the base 310, the printed circuit board 330 and the envelope 320 of the LED lamp 300 in this embodiment are similar to those of the LED lamp in other embodiments, which will not be repeated here.

In an embodiment of the present disclosure, the printed circuit board 330 is substantially in a shape of a hollow hexahedron comprising six rectangular flat mounting sides 332. The plurality of LED chips 350 are evenly distributed on the upper half of the mounting sides 332, and the driver circuit 340 is integrated on the lower half of one mounting side 332. The LED chips 350 and the driver circuit 340 are integrated on the printed circuit board 330, which can simplify the structure of the LED lamp 300 and reduce a number of parts of the LED lamp 300, thereby reducing assembling steps of the LED lamp.

Referring to FIG. 15, the LED lamp 300 further includes a supporting member 360 for supporting and fixing the printed circuit board 330. The supporting member 360 comprises a hollow base portion 361. The base portion 361 defines a mounting slot 362 having a shape matching the printed circuit board 330. The mounting slot 362 is substantially in a shape of hexahedron for accommodating and fixing a bottom end of the printed circuit board 330. The printed circuit board 330 is vertically accommodated in the mounting slot 362 along a central axis of the envelope 320 and the base 310. The base portion 361 comprises a base thread 364 on an outer surface thereof, and the base thread 364 is configured to mate with the internal thread 311 of the base 310 to mount and fix the supporting member 360 in the base 310. In this embodiment, the supporting member 360 is integrally made of a thermally conductive material. The supporting member 360 may be integrally made of thermally conductive polymer, thermally conductive plastic or thermally conductive resin. In fact, the supporting member 360 can also be made of other thermally conductive materials such as silica gel. Alternatively, the supporting member 360 may be made of a metal material having thermal conductivity. The supporting member 360 is completely received in the base 310, and mates with the base 310 via thread, so that heat generated by the printed circuit board 330 is conducted out of the LED lamp 300 through the base 310. In the LED lamp 300 according to the embodiments of the present disclosure, the heat generated by the printed circuit board 330 can be conducted to the outside of the base 310 via the supporting member 360 by coupling the supporting member 360 with the base 310, so that the LED lamp has better heat dissipation effect.

When assembling, the printed circuit board 330 integrated with the plurality of LED chips 350 and the driver circuit 340 can be firstly accommodated and fixed in the mounting slot 362 of the supporting member 360. Then, the supporting member 360 installed with the circuit printed board 330 is installed and fixed in the base 310. Then, the bottom portion 322 of the envelope 320 is installed in the base 310 and finally fixed and sealed with glue.

In the embodiment of the present disclosure, the hollow polyhedral printed circuit board 130, 230, 330 is supported and fixed by the supporting member 160, 260, 360. One end of the printed circuit board 130, 230, 330 is fixed on the supporting member 160, 260, 360 and extends into the base 110, 210, 310, and the other end of the printed circuit board 130, 230, 330 is suspended in the envelope 120, 220, 320. Thus, the area of mounting sides of the printed circuit board 130, 230, 330 is increased compared to a conventional printed circuit board. The plurality of LED chips 150, 250, 350 can be dispersedly provided on the printed circuit board 130, 230, 330, which enhances the self-cooling effect of the LED lamp 100, 200, 300. Meanwhile, the structure of the LED lamp 100, 200, 300 is also simplified. No additional heat sink is needed and no gas is required to be supplied to the LED lamp for heat dissipation. In particular, the supporting member 160, 260, 360 made of the thermally conductive material engages with the base 110, 210, 310, and the heat generated by the printed circuit board 130, 230, 330 can be conducted out of the LED lamp via the base 110, 210, 310, which further enhances the self-cooling effect of the LED lamp. Meanwhile, the number of LED lamp parts is reduced, and the production process of the LED lamp is simplified, thereby reducing the production cost of the LED lamp. Moreover, in the present disclosure, the driver circuit 140, 340 may be integrally disposed on the printed circuit board 130, 230, or the driver circuit 240 is fixed and retained by the supporting member 260, which also simplifies the structure of the LED lamp, thus reducing the manufacturing cost of the LED lamp. Meanwhile, the hollow polyhedral printed circuit board can increase the mounting area of the printed circuit board, and enable the LED chips to be installed more discretely, which is beneficial to the heat dissipation of the LED lamp. Meanwhile, the luminous effect of the LED lamp is optimized. In addition, the supporting member 160, 260, 360 is integrally formed of a heat-conducting material, which also simplifies the manufacture and assembly process of the LED lamp.

The specification uses detailed embodiments to describe the present disclosure, including the best mode, and can help any person skilled in the art of the disclosure to perform experimental operations. These operations include using any device and system and using any specific method. The scope of the disclosure is defined by the claims, and may include other examples that occur in the technical field. Such other examples are intended to be within the scope of the claims of the disclosure if they are not structurally different from the literal language of the claims or they have equivalent structures as described in the claims.

The invention claimed is:

1. A LED lamp, comprising:

a heat dissipating base;

an envelope with a bottom end coupled with the base, the envelope defining an interior between the base and the envelope;

a printed circuit board which is disposed in the interior, the printed circuit board being suitable for mounting a plurality of LED chips wherein:

the printed circuit board comprises a unitary sheet of flexible material which is shaped along a long axis into a linearly-extended, annular hollow structure comprising a plurality of flat, rectangular sides with a first end extended into the base, and a mounting surface area of the printed circuit board is configured with a mounting area for the LED chips which is determined to dissipate the heat from the LED chips;

a thermally conductive supporting member which mechanically and thermally couples the first end of the printed circuit board with the base; and the plurality of LED chips which are mounted on the printed circuit board in a plurality of columns distributed along the flat, rectangular sides, each column having two or more LED chips, wherein the plurality of LED chips are distributed substantially evenly both around an annular aspect and along the long axis of the printed circuit board;

wherein the annular unitary printed circuit board, the mounting area of the printed circuit board, the thermally conductive supporting member, the distribution of the LED chips, and the heat dissipating base provide for heat conduction from the LED lamp via the base, and the printed circuit board, heat dissipating base, and thermally conductive supporting member function together to dissipate heat: (i) in lieu of a dedicated heat sink positioned on the printed circuit board and proximate to the LED chips;

and (ii) in lieu of an interior heat conducting gas.

2. The LED lamp of claim 1, wherein the base defines an internal thread, and the supporting member defines a corresponding thread structure for mating and for efficient thermal transfer with the internal thread of the base.

3. The LED lamp of claim 1, further comprising a driver circuit integrated on the printed circuit board, wherein:

the driver circuit is placed on the printed circuit board with a placement in relation to the plurality of LED chips, and the surface area of the printed circuit board is so sized, that the printed circuit board dissipates (i) a heat of the driver circuit and (ii) the combined heat generated by the plurality of LED chips, without the dedicated heat sink and without the interior heat conducting gas.

4. The LED lamp of claim 1, wherein the supporting member comprises a base element, a supporting element extending upwardly from one end of the base element, and a pair of latch elements at two sides of the supporting element and extending in the same direction as the supporting element.

5. The LED lamp of claim 4, wherein the printed circuit board is retained between the supporting element and the latch elements of the supporting member, and the printed circuit board defines a pair of holes for matching with the latch elements of the supporting member.

6. The LED lamp of claim 1, wherein the supporting member comprises a base element, a floor element within the base element, at least one pair of holding elements extending upwardly from a top end of the floor element, at least one pair of guiding elements corresponding to the holding elements and extending downwardly from a bottom end of the floor element, and the printed circuit board comprises a plurality of projection elements extending from a bottom end of the printed circuit board.

7. The LED lamp of claim 6, further comprising a plurality of position holes corresponding to the plurality of projection elements of the printed circuit board and separately provided on the floor element of the supporting member.

8. The LED lamp of claim 6, wherein the at least one pair of holding elements comprise two pairs of internal holding elements positioned at a radially inner element of the floor element and two pairs of external holding elements positioned at a radially outer element of the floor element, a protrusion is defined between two adjacent internal holding elements in each pair, a driver circuit board is fixed in the guiding elements and the internal holding elements, and the driver circuit board comprises a slot corresponding to the protrusion of the supporting member.

9. The LED lamp of claim 1, wherein the supporting member comprises a mounting slot having a shape matching the printed circuit board and configured to accommodate and fix the printed circuit board.

10. The LED lamp of claim 1, wherein the supporting member comprises at least one of a thermally conductive polymer, a thermally conductive plastic, a thermally conductive resin, and a silica gel.

11. The LED lamp of claim 1, wherein the annular hollow structure forming the printed circuit board further comprises a second end which is open and unobstructed.

12. A LED lamp, comprising:

a base;

an envelope with a bottom end coupled with the base, the envelope defining an interior between the base and the envelope;

a printed circuit board which is disposed in the interior, the printed circuit board comprising a hollow structure, the printed circuit board suitable for conducting heat;

a supporting member with a first end of the supporting member assembled in the base, a second end of the supporting member being coupled with the printed circuit board wherein the second end of the printed circuit board extends into the base; and a plurality of LED chips so mounted and arranged on the printed circuit board such that the printed circuit board dissipates the heat generated from the plurality of LED chips;

wherein:

the supporting member comprises a base element, a floor element within the base element, at least one pair of holding elements extending upwardly from a top end of the floor element, at least one pair of guiding elements corresponding to the holding elements and extending downwardly from a bottom end of the floor element, and the printed circuit board comprises a plurality of projection elements extending from a bottom end of the printed circuit board; and the at least one pair of holding elements comprise two pairs of internal holding elements positioned at a radially inner element of the floor element and two pairs of external holding elements positioned at a radially outer element of the floor element, a protrusion is defined between two adjacent internal holding elements in each pair, a driver circuit board is fixed in the guiding elements and the internal holding elements, and the driver circuit board comprises a slot corresponding to the protrusion of the supporting member.

13. The LED lamp of claim 12, wherein the supporting member is thermally conductive;

wherein the printed circuit board, the heat dissipating base, and the thermally conductive supporting member function together to dissipate heat: (i) in lieu of a dedicated heat sink positioned on the printed circuit board and proximate to the LED chips; and (ii) in lieu of an interior heat conducting gas.

14. The LED lamp of claim 12, wherein a second end of the printed circuit board is an open and unobstructed end which is oriented towards a spherical top element of the envelope.

15. A LED lamp comprising:

a heat dissipating base;

an envelope with a bottom end coupled with the base, the envelope defining an interior between the base and the envelope;

a printed circuit board disposed in the interior and comprising a flexible material shaped into a linearly-extended, annular hollow structure with a first end extended into the base, and a second end which is open and is oriented towards a spherical top element of the envelope;

a thermally conductive supporting member which mechanically couples the first end of the printed circuit board with the base;

a plurality of LED chips mounted and distributed evenly both around an annular aspect of the printed circuit board and along a long axis of the printed circuit board so that a mounting surface area of the printed circuit board dissipates heat from the LED chips without a dedicated heat sink and without an interior heat conducting gas;

wherein the printed circuit board, the heat dissipating base, and the thermally conductive supporting member function together to dissipate heat: (i) in lieu of a dedicated heat sink positioned on the printed circuit board and proximate to the LED chips; and (ii) in lieu of an interior heat conducting gas.

16. The LED lamp of claim 15, further comprising a driver circuit integrated on the printed circuit board, wherein:

the driver circuit is placed on the printed circuit board with a placement in relation to the plurality of LED chips, and the surface area of the printed circuit board is so sized, that the printed circuit board dissipates (i) a heat of the driver circuit and (ii) the combined heat generated by the plurality of LED chips, without the dedicated heat sink and without the interior heat conducting gas.

* * * * *